US010036405B2

(12) United States Patent
Saito

(10) Patent No.: US 10,036,405 B2
(45) Date of Patent: Jul. 31, 2018

(54) IMPELLER ROTATOR AND METHOD OF ASSEMBLING SAID IMPELLER ROTATOR

(71) Applicant: ASANO GEAR CO., LTD., Osakasayama, Osaka (JP)

(72) Inventor: Hirotsugu Saito, Osakasayama (JP)

(73) Assignee: ASANO GEAR CO., LTD., Osakasayama, Osaka (JP)

( * ) Notice: Subject to any disclaimer, the term of this patent is extended or adjusted under 35 U.S.C. 154(b) by 403 days.

(21) Appl. No.: 14/414,575

(22) PCT Filed: Jul. 12, 2013

(86) PCT No.: PCT/JP2013/069191
§ 371 (c)(1),
(2) Date: Jan. 13, 2015

(87) PCT Pub. No.: WO2014/013952
PCT Pub. Date: Jan. 23, 2014

(65) Prior Publication Data

US 2015/0167695 A1 Jun. 18, 2015

(30) Foreign Application Priority Data

Jul. 17, 2012 (JP) ..... 2012-158822

(51) Int. Cl.
*F04D 29/66* (2006.01)
*F01D 5/02* (2006.01)
(Continued)

(52) U.S. Cl.
CPC ..... *F04D 29/662* (2013.01); *F01D 5/027* (2013.01); *F01D 25/04* (2013.01); *F04D 29/20* (2013.01);
(Continued)

(58) Field of Classification Search
CPC ..... F04D 29/20; F04D 29/662; F04D 29/266; F01D 24/04; F01D 5/027; F01D 25/04;
(Continued)

(56) References Cited

U.S. PATENT DOCUMENTS 4,519,747 A * 5/1985 Yamazaki ..... F01D 5/025 29/432
4,872,817 A * 10/1989 De Kruif ..... F01D 5/025 416/244 A
2012/0039555 A1 2/2012 Tabata

FOREIGN PATENT DOCUMENTS

DE 24 55 279 A1 8/1976
DE 10 2009 035172 A1 2/2011
(Continued)

OTHER PUBLICATIONS

Hayate, 14414575_JP-S6136510_EngSumTrans.pdf , Jul. 27, 1984.*
(Continued)

*Primary Examiner* — Kenneth J Hansen
(74) *Attorney, Agent, or Firm* — Hauptman Ham, LLP

(57) ABSTRACT

An impeller rotator (21) includes a turbine impeller (11), a compressor impeller (12), a shaft (13) connecting the turbine impeller (11) to the compressor impeller (12), and a connecting member (16) fastening one of the turbine impeller and the compressor impeller to one axial end region of the shaft, and the connecting member (16) is plastic-deformed so as to decrease overall imbalance of the turbine impeller (11), the compressor impeller (12), and the shaft (13).

9 Claims, 3 Drawing Sheets

(51) Int. Cl.
*F04D 29/26* (2006.01)
*F01D 25/04* (2006.01)
*F04D 29/20* (2006.01)

(52) U.S. Cl.
CPC ..... *F04D 29/266* (2013.01); *F04D 29/666* (2013.01); *F05D 2220/40* (2013.01); *Y10T 29/49243* (2015.01)

(58) Field of Classification Search
CPC ..... F16F 15/32; Y10T 29/49316; Y10T 29/4932; Y10T 29/49243
USPC ..... 464/180; 73/455
See application file for complete search history.

(56) References Cited

FOREIGN PATENT DOCUMENTS

| | | | | | |
|---|---|---|---|---|---|
| DE | 102009035172 | A1 | * | 2/2011 | ..... G01M 1/26 |
| JP | 58-124002 | A | | 7/1983 | |
| JP | S61-36510 | A | | 2/1986 | |
| JP | 62-91629 | A | | 4/1987 | |
| JP | 6-160755 | A | | 6/1994 | |
| JP | 2000-310290 | A | | 11/2000 | |
| JP | 2000-329637 | A | | 11/2000 | |
| JP | 2003032925 | | * | 1/2003 | ..... H02K 1/26 |
| JP | 2003032925 | A | | 1/2003 | |
| JP | 2003-184468 | A | | 7/2003 | |
| JP | 2008-223569 | A | | 9/2008 | |
| JP | 2011-122538 | A | | 6/2011 | |

OTHER PUBLICATIONS

Muller et al., 14414575_2017-01-04_DE_102009035172_A1_l_MachTrans.pdf, Feb. 10, 2011.*
International Search Report for corresponding International Application No. PCT/JP2013/069191, dated Aug. 13, 2013.
Supplementary European Search Report for corresponding European Application No. 13 82 0138, dated Feb. 15, 2016.

* cited by examiner

IMPELLER ROTATOR AND METHOD OF ASSEMBLING SAID IMPELLER ROTATOR

TECHNICAL FIELD

The present invention relates to a technique of correcting rotational balance of a turbine impeller and a compressor impeller that rotates at high speed in a turbo charger of an engine, a gas turbine, and the like.

BACKGROUND ART

A turbo charger that uses exhaust gas of an engine to increase intake gas of the engine includes a turbine impeller rotated by the exhaust gas and a compressor impeller that feeds air into a combustion chamber of the engine. The turbine impeller and the compressor impeller are fastened to each other via a shaft to form an assembly, and rotate in the turbo charger at high speed. Because the RPM of the assembly reaches 100,000 to 200,000 per minute, the center-of-mass of the assembly is displaced from the rotary axis, rotational balance degrades, contributing to noise and runout during high-speed rotation.

With a recent increase in demand for quietness of automobiles, the standard of rotational balance in the assembly (hereinafter referred to as impeller rotator) has gradually become strict. To correct imbalance of the impeller rotator, Japanese Unexamined Patent Publication No. 2008-223569 (Patent Document 1) describes that rotational balance is corrected by removing some parts from the turbo charger to form a gap behind the turbo charger, inserting a cutting tool into the gap, and cutting the back face of the turbine impeller with the tool.

This intends to correct overall rotational balance of the impeller rotator including the compressor impeller and the turbine impeller.

PRIOR ART DOCUMENT

Patent Document

Patent Document 1: Japanese Unexamined Patent Publication No. 2008-223569

SUMMARY OF THE INVENTION

Problems to be Solved by the Invention

However, such conventional turbo charger has following problems. That is, according to an operational flow shown in FIG. 4 of Patent Document 1, a compressor impeller side is cut to correct its rotational balance in a first step, a turbine impeller side is cut to correct its rotational balance in a second step, the compressor impeller side is cut again to correct its rotational balance in a third step, the turbine impeller side is cut again to correct its rotational balance in a fourth step and then, these steps are repeated until rotational balance of both the compressor impeller and the turbine impeller falls within a proper range, which is a complicated process. Moreover, the cut amount may be large, requiring disposal of the parts of the impeller rotator.

Further, as described in paragraph [0025] in Patent Document 1, in correcting balance of the compressor impeller side, a nut attached to the rotational center of the compressor impeller may be cut to an allowable cut amount and thus, the cut amount disadvantageously becomes too much.

In consideration of the above-mentioned circumstances, an object of the present invention is to provide a method and an impeller rotator that can eliminate the complicatedness of the repeated correcting operations, and reduce the cut amount in the correcting operation to achieve labor saving of the correcting operation.

Solutions to the Problems

To attain the object, an impeller rotator according to the present invention includes a turbine impeller having imbalance around a rotary axis, a compressor impeller having imbalance around a rotary axis, a shaft configured to connect the turbine impeller to the compressor impeller, and a connecting member attached to one axial end of the shaft to fasten one of the turbine impeller and the compressor impeller to one axial end region of the shaft. The connecting member is plastic-deformed so as to decrease overall imbalance of the turbine impeller, the compressor impeller, and the shaft.

According to the present invention, only plastic deformation of the connecting member enables correction of rotational balance of the impeller rotator. Thus, the final rotational balance correcting operation can be completed using a smaller number of processing steps, which is more advantageous than the conventional rotational balance correcting method including a large cut amount. Further, the complicated process of cutting the side of the compressor impeller to correct its rotational balance, and cutting the side of the turbine impeller to correct its rotational balance and then, repeating such cutting until rotational balance of the impeller rotator falls within a proper range can be eliminated, efficiently manufacturing the impeller rotator. This can improve the efficiency of the assembling operation.

The remaining imbalance amount of the impeller rotator may be offset to be almost 0 by cutting the rear face of the turbine impeller or the rear face of the compressor impeller before connecting the impellers to each other to make the imbalance amount of the turbine impeller substantially same as the imbalance amount of the compressor impeller and then, connecting the impellers to each other such that the imbalance direction of the turbine impeller and the imbalance direction of the compressor impeller form an angle of 180 degrees therebetween. The final rotational balance correcting operation after the connection in opposite phases may be performed by plastic-deforming the connecting member, or by cutting any portion of the impeller rotator more slightly than conventional, adding a weight to any portion of the impeller rotator, or plastic-deforming any portion of the impeller rotator.

In an embodiment of the present invention, the other axial end of the shaft is integrated with the other of the turbine impeller and the compressor impeller. In such embodiment, the impeller rotator is assembled using a shaft-equipped impeller including one impeller and a shaft in an integrated manner, improving the efficiency of the assembling operation. In another embodiment, the shaft may be separated from both the impellers, and the turbine impeller, the shaft, and the compressor impeller may be fastened to each other at assembling.

In a preferred embodiment of the present invention, the connecting member is a nut screwed to one axial end of the shaft. In such embodiment, the impeller is fastened to the shaft with the mass-produced nut, which is advantageous in terms of cost. In another embodiment, any member other than the nut may be used. Alternatively, one of the turbine impeller and the compressor impeller may be fastened to the one axial end of the shaft by press-fitting, shrink-fitting, or welding.

Examples of plastic deformation of the nut include various means such as bending and caulking. One axial end of the nut may be plastic-deformed, or the other axial end of the nut may be plastic-deformed. In a preferred embodiment of the present invention, the nut has one axial end extending further than the one axial end of the shaft in one axial direction, and the one axial end of the nut is caulked to correct rotational balance of the impeller rotator. In this embodiment, rotational balance of the impeller rotator can be easily corrected using the caulking tool. Further, since the caulked portion protrudes from the shaft in the axial direction, the impeller rotator can be disassembled without damaging the shaft. In another embodiment, rotational balance may be corrected by cutting of the nut in addition to caulking.

The present invention is not limited to one embodiment. In another embodiment, the nut may have a plurality of projections spaced around the rotary axis, and the projections may be bent to correct rotational balance of the impeller rotator. In such embodiment, rotational balance of the impeller rotator can be easily corrected by bending one or more projections so as to move closer to or away from the rotary axis.

The projections may be provided at any position. For example, the projections are arranged at the one axial end of the nut, and protrude further than the one axial end of the shaft. In such embodiment, the projections can be bent without interfering with the one axial end of the haft. Alternatively, the projections may be provided on the outer peripheral face of the nut, and protrude outward in the radial direction.

In the impeller rotator according to the present invention, the connecting member is plastic-deformed and however, other potions may be plastic-deformed. In an embodiment, an impeller rotator includes a turbine impeller having imbalance around its rotary axis, a compressor impeller having imbalance around its rotary axis, a shaft configured to connect the turbine impeller to the compressor impeller, and a connecting member attached to one axial end of the shaft to fasten one of the turbine impeller and the compressor impeller to one axial end region of the shaft. One of the turbine impeller, the compressor impeller, and the shaft may be plastic-deformed so as to decrease overall imbalance of the turbine impeller, the compressor impeller, the shaft, and the connecting member. Also in such embodiment, only plastic deformation enables correction of rotational balance of the impeller rotator.

The present invention can be applied to the above-mentioned impeller rotator, as well as rotators without impeller, such as a motor shaft of a motor, and other rotators. A rotator according to the present invention includes a rotating member having imbalance around its rotary axis, a shaft connected to the rotating member, and a connecting member attached to one axial end of the shaft to fasten the rotating member to one axial end region of the shaft. One of the rotating member, the shaft, and the connecting member may be plastic-deformed so as to decrease overall imbalance of the rotating member, the shaft, and the connecting member. In such embodiment, in the rotator rotating at high speed, only plastic deformation enables correction of rotational balance of the rotator. The rotating member according to the present invention may be any mass body such as a disc and a cylinder, and any member fastened to the shaft such as a rotor of a motor and a gear, and is not specifically limited.

A method of assembling the impeller rotator according to the present invention includes a step of preparing a shaft-equipped impeller having an impeller part and a shaft part protruding from the impeller part and extending along a rotary axis, and measuring an imbalance direction of the shaft-equipped impeller around the rotary axis, a step of preparing a second impeller, and measuring an imbalance direction of the second impeller around the rotary axis, a step of attaching the second impeller to a tip of the shaft part such that the imbalance direction of the shaft-equipped impeller and the imbalance direction of the second impeller form an angle of 180 degrees therebetween, a step of further attaching a connecting member at a tip of the shaft part to fasten the second impeller to the tip of the shaft part, and a step of processing the connecting member to decrease overall imbalance amount According to the present invention, because the imbalance direction of the turbine impeller and the imbalance direction of the compressor impeller are in opposite phases, the imbalance of the turbine impeller is offset with the imbalance of the compressor impeller. Accordingly, the impeller rotator having a good rotational balance can be manufactured. Further, according to the present invention, because the remaining imbalance amount of the impeller rotator after the compensation becomes small, and the remaining imbalance direction is identified, the remaining imbalance amount can be eliminated in the small number of processing steps after the fastening. As an example, the shaft-equipped impeller includes the turbine impeller, and the second impeller is the compressor impeller. As another example, the shaft-equipped impeller includes the compressor impeller, and the second impeller is the turbine impeller.

Effects of the Invention

As described above, according to the present invention, the remaining imbalance amount after assembling of the turbine impeller and the compressor impeller is reduced by plastic deformation of the connecting member, achieving an impeller rotator having a good rotational balance. Moreover, man hours for the rotational balance correcting operation are reduced, and the operation of correcting rotational balance of the turbine impeller and rotational balance of the compressor impeller can be prevented from being repeated.

EMBODIMENTS OF THE INVENTION

Embodiments of the present invention will be described below in detail with reference to figures.

Figure 1:
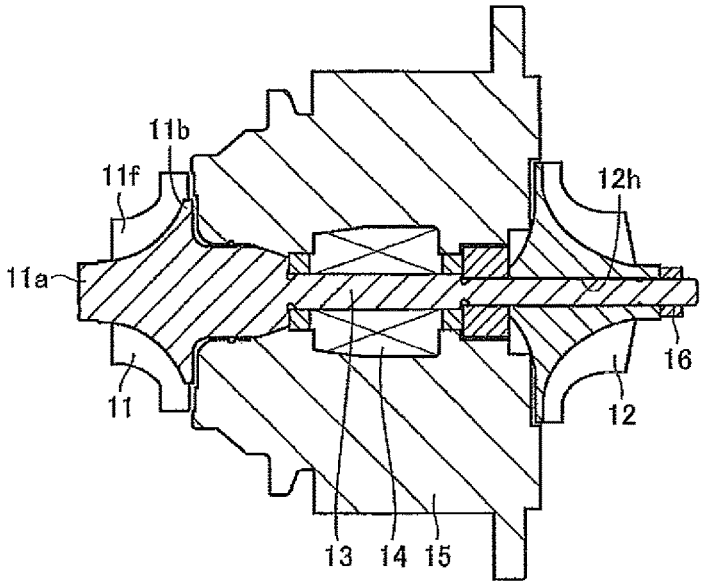
FIG. 1 is a vertical sectional view illustrating a turbo charger provided with an impeller rotator in accordance with an embodiment of the present invention.
Figure 2:
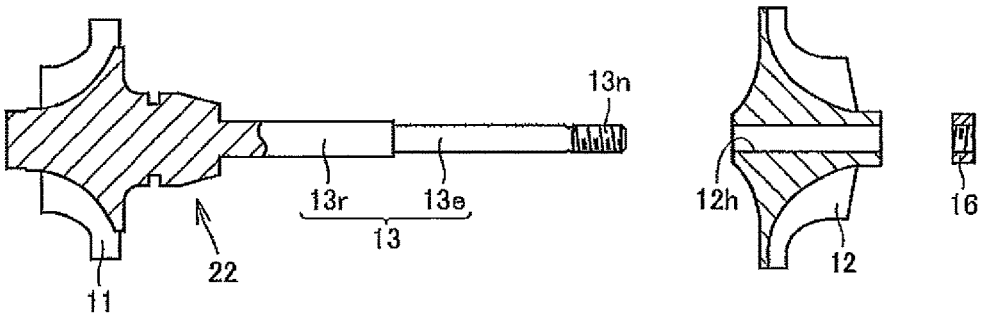
FIG. 2 is an exploded view illustrating the impeller rotator in accordance with the embodiment.

FIG. 1 is a vertical sectional view illustrating a turbo charger provided with an impeller rotator in accordance with an embodiment of the present invention, and does not show some constituents. FIG. 2 is an exploded side view illustrating the impeller rotator in accordance with the embodiment when viewed from the direction perpendicular to the rotary axis. The turbo charger in this embodiment includes a turbine impeller 11, a compressor impeller 12, a shaft 13, a bearing 14, and a center housing 15.

The turbine impeller 11 has a rear face portion 11*b* that extends perpendicular to the rotary axis, an axial portion 11*a* that extends along the rotary axis, and a plurality of wing portions 11*f* that extend from the axial portion 11*a* in the outer radial direction, and are connected to the rear face portion 11*b*. The compressor impeller 12 has the substantially same configuration as the turbine impeller 11.

The compressor impeller 12 is disposed on one side of the center housing 15 such that its rear face faces the center housing 15. The turbine impeller 11 is disposed on the other side of the center housing 15 such that the rear face portion 11*b* faces the center housing 15. The shaft 13 penetrates the center housing 15, and is rotatably supported by the bearing 14 provided in the center housing 15. In a modification example not shown, the shaft 13 extends in the center housing 15 without penetrating the center housing 15.

The shaft 13 linearly extends along the common rotary axis of the turbine impeller 11 and the compressor impeller 12. One axial end of the shaft 13 is connected to the compressor impeller 12, and the other axial end of the shaft 13 is connected to the turbine impeller 11. Thereby, the turbine impeller 11, the compressor impeller 12, and the shaft 13 constitute one impeller rotator 21. The turbine impeller 11 is integrated with the shaft 13 to constitute a shaft-equipped impeller 22. The shaft 13 protrudes from the rear face portion 11*b* of the turbine impeller 11, and extends in one axial direction. A tip region 13*e* of the shaft 13, which is located on one axial side, has a smaller diameter than a bottom region 13*r* of the shaft 13, which is located on the other axial side. The outer peripheral face of the bottom region 13*r* is rotatably supported by the bearing 14. Although not represented as a reference numeral, a thrust bearing is interposed between the shaft 13 and the center housing. The thrust bearing receives an axial force of the shaft 13.

The compressor impeller 12 has a through hole 12*h* extending along the rotary axis of the compressor impeller 12. The tip region 13*e* of the shaft 13 is inserted into the through hole 12*h* from the side of the center housing 15. A male screw 13*m* is provided on the outer periphery of the shaft tip protruding from the through hole 12*h* in the one axial direction, and is screwed into a nut 16. This fastens the compressor impeller 12 to the shaft 13. The shaft 13 and the compressor impeller 12 may be prevented from rotating with respect to each other by means of uneven engagement as found between a key and a groove.

When the turbine impeller 11 is rotated by the exhaust gas discharged from an engine not shown in a turbo charger, the compressor impeller 12 rotates integrally with the turbine impeller 11, feeding air into the engine.

Figure 3:
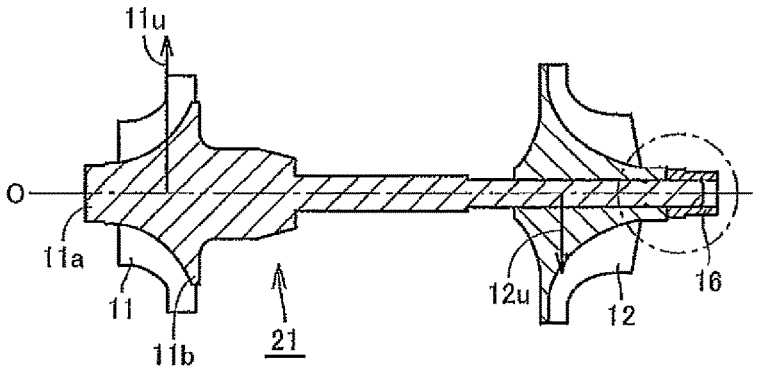
FIG. 3 is a vertical sectional view illustrating imbalance distribution of the impeller rotator.

FIG. 3 is a vertical sectional view illustrating imbalance distribution of the impeller rotator 21 taken along a plane including a rotary axis O. The turbine impeller 11 and the compressor impeller 12 each are manufactured such that the center-of-mass matches the rotary axis O. In fact, however, precise measurement of rotational balance of the turbine impeller 11 and the compressor impeller 12 demonstrates that the center-of-mass does not match the rotary axis O. In this embodiment, an imbalance direction 11*u* of the turbine impeller 11 is marked around the rotary axis O. The marking may be made on the outer edge of the rear face portion 11*b* or on one end of the axial portion 11*a* further from the rear face portion 11*b*. Similarly, an imbalance direction 12*u* of the compressor impeller 12 is marked around the rotary axis O. Then, the turbine impeller 11 is connected to the compressor impeller 12 such that the marking of the turbine impeller 11 and the marking of the compressor impeller 12 have an angle of 180 degrees therebetween.

In this embodiment, as shown in FIG. 3, the imbalance amount of the turbine impeller 11 is substantially offset to the imbalance amount of the compressor impeller 12, resulting in that the imbalance amount of the impeller rotator 21 becomes smaller than conventional art or almost 0.

Figure 4:
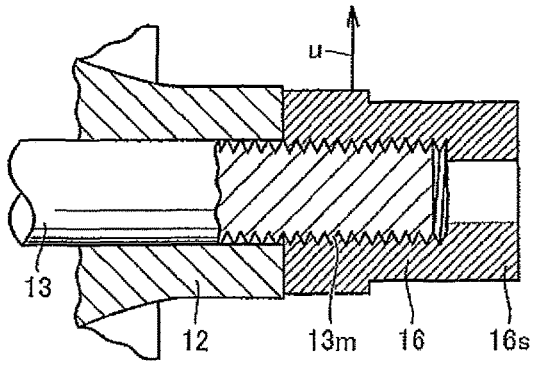
FIG. 4 is a vertical enlarged sectional view illustrating a site where a shaft is screwed to a nut.

FIG. 4 is a vertical enlarged sectional view illustrating a site where the shaft is screwed to the nut, that is, a site surrounded by a dot-and-dash line in FIG. 3. When the imbalance amount of the turbine impeller 11 is larger than the imbalance amount of the compressor impeller 12 as represented by length of arrows in FIG. 3, the compensation of the imbalance amount becomes incomplete, so that the imbalance direction of the turbine impeller 11 still remains as the imbalance direction of the impeller rotator 21.

Thus, by plastic-deforming the nut 16 after assembling the impeller rotator 21, the remaining imbalance amount of the impeller rotator 21 is finally eliminated. Such correction of rotational balance is performed by first measuring the imbalance direction of the impeller rotator 21 before plastic deformation to find an imbalance direction u of the impeller rotator 21, and making a marking on the nut 16, and then, caulking one axial end of the nut 16 with reference to the marking on the nut 16. Caulking in the imbalance direction u makes the portion of the nut 16 in the imbalance direction u lost, eliminating imbalance. The imbalance direction u of the impeller rotator 21 and the imbalance amount of the impeller rotator 21 prior to plastic deformation can be calculated by subtracting the imbalance amount of the compressor impeller 12 from the imbalance amount of the turbine impeller 11.

Figure 5:
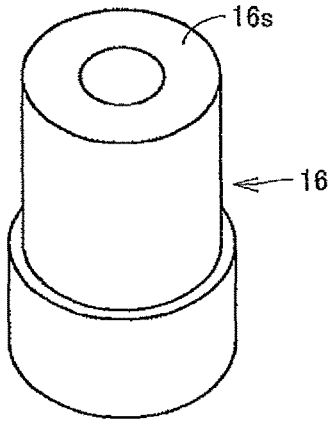
FIG. 5 is a perspective view illustrating an uncaulked nut.
Figure 6:
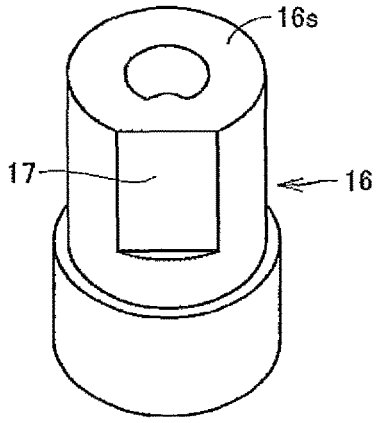
FIG. 6 is a perspective view illustrating a caulked nut.

The nut 16 screwed to the one axial end of the shaft 13 has one axial end 16*s* extending further from the one axial end of the shaft 13 in the one axial direction. The nut 16 is caulked to correct rotational balance of the impeller rotator 21 at the one axial end 16*s* further from the turbine impeller 11 and the compressor impeller 12. FIG. 5 is a perspective view illustrating an uncaulked nut. FIG. 6 is a perspective view illustrating a caulked nut. By applying a force to the one axial end 16*s* by use of a caulking tool not shown, a caulked portion 17 is formed on the one axial end 16*s*, and the nut 16 is plastic-deformed as shown in FIG. 6.

Figure 7:
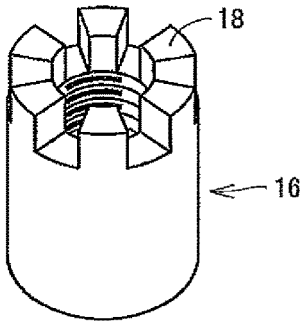
FIG. 7 is a perspective view illustrating a nut in a modification example.

In place of the nuts 16 shown in FIG. 5 and FIG. 6, a nut in a modification example as shown in FIG. 7 may be used. The nut 16 shown in FIG. 7 has a plurality of projections 18, 18, . . . at the one axial end further from the turbine impeller 11 and the compressor impeller 12, which are spaced around the rotary axis O. Such crown-shaped nut 16 is screwed and fastened to the one axial end of the shaft 13, and the projections 18 located in the circumferential direction corresponding to the imbalance direction u of the impeller rotator 21 are bent, thereby correcting rotational balance of the impeller rotator 21.

Figure 8:
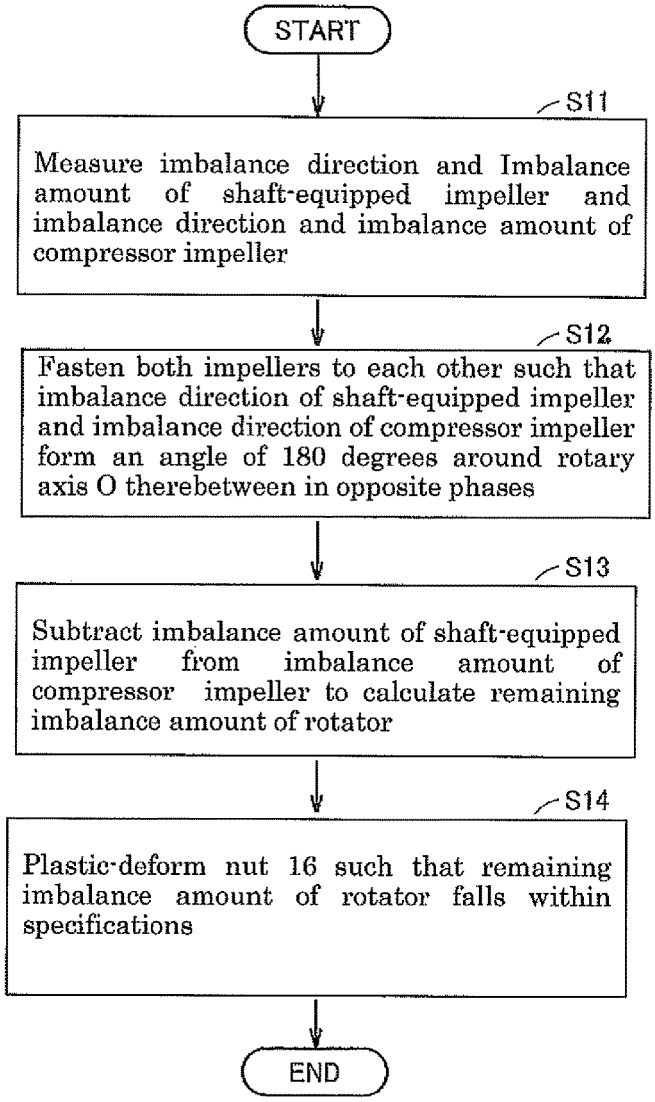
FIG. 8 is a flow chart illustrating a method of assembling the impeller rotator in accordance with an embodiment of the present invention.

In the nut 16 in FIG. 8, the projections 18 are provided at the one axial end of the nut 16. Then, in the state where the male screw 13*n* of the shaft 13 is screwed into and fastened to the nut 16, the projections 18 protrude further from the one axial end of the shaft 13 in the one axial direction. As a result, the projections 18 can be bent in the radial direction without interfering with the one axial end of the shaft 13, preferably eliminating remaining imbalance amount of the impeller rotator 21.

FIG. 8 is a flow chart illustrating a method of assembling the impeller rotator 21 in accordance with an embodiment of the present invention. First, in Step S11, the imbalance direction and the imbalance amount of each of the shaft-equipped impeller 22 and the compressor impeller 12 are measured.

In next Step S12, the shaft-equipped impeller 22 is fastened to the compressor impeller 12 such that the imbalance directions are in opposite phases to have an angle of 180 degrees around the rotary axis O therebetween. Specifically, the shaft 13 is inserted into the center housing 15, allowing the tip region 13*e* of the shaft 13 to protrude toward one side of the center housing 15, and enter the through hole 12*h* of the compressor impeller 12. Then, the nut 16 is tightened in the opposite phase state. Thereby, the two impellers 11 and 12 are fastened to each other. The angle of 180 degrees can be achieved by marking the imbalance direction of the shaft-equipped impeller 22 on the outer peripheral face of the shaft-equipped impeller 22 and the imbalance direction of the compressor impeller 12 on the outer peripheral face of the compressor impeller 12, and disposing the markings with 180 degrees therebetween.

In next Step S13, the remaining imbalance amount is calculated by subtracting the imbalance amount of the shaft-equipped impeller 22 from the imbalance amount of the compressor impeller 12. In next Step S14, the nut 16 is plastic-deformed such that the remaining imbalance amount falls within specifications. Preferably, the specification value in Step S14 is a possible lowest value close to 0. Thereby, the remaining imbalance amount of the impeller rotator 21 becomes almost 0, completing correction of rotational balance of the impeller rotator 21.

In this embodiment, because the turbine impeller is connected to the compressor impeller such that the marking of the turbine impeller 11 and the marking of the compressor impeller 12 form an angle of 180 degrees therebetween, the imbalance direction of the turbine impeller 11 and the imbalance direction of the compressor impeller 12 are in opposite phases. Therefore, the remaining imbalance amount after assembling becomes small to achieve the impeller rotator having a good rotational balance.

In this embodiment, because the remaining imbalance amount of the impeller rotator is small, and the remaining imbalance direction of the impeller rotator is identified, only slightly caulking the nut 16 enables correction of rotational balance. Therefore, the correction can be completed using a smaller number of processing steps, which is more advantageous than the conventional rotational balance correcting method including a large cut amount. Moreover, the complicated process of cutting the side of the compressor impeller to correct its rotational balance, and cutting the side of the turbine impeller to correct its rotational balance and then, repeating such cutting until rotational balance of the impeller rotator falls within a proper range can be eliminated, efficiently manufacturing the impeller rotator 21.

Because the nut 16 is plastic-deformed rather than being cut, the nut 16 can be reused to reduce disposal costs of the nut 16.

Although the one axial end 16*s* of the nut 16 is plastic-deformed as shown in FIG. 6 and FIG. 7, the other axial end not shown of the nut 16 near the compressor impeller 12 may be plastic-deformed. This can prevent loosening of the nut 16. Further, to prevent loosening of the nut 16, an anti-loosening member separated from the nut 16 may be attached to the one axial end of the shaft 13, and the final rotational balance correcting operation after assembling may be performed by plastic-deforming the anti-loosening member. Alternatively, the final rotational balance correcting operation after assembling may be performed by attaching still another member to the outer peripheral face of the shaft 13 and plastic-deforming the member.

In the final rotational balance correcting operation after assembling, one site is processed in FIG. 6 and however, two or three sites that are spaced in the circumferential direction may be processed. The correction of rotational balance is not limited to the correction of one plane of the nut 16, and may be also applied to polyhedral rotators having multiple planes spaced in the axial direction.

Although not shown, the nut 16 and the impeller may be coaxially disposed by providing a first tapered face on the nut 16 and a second tapered face on the impeller in contact with the nut 16, and fastening the nut 16, thereby bringing the first and second tapered faces into contact with each other for tapering engagement. The tapered face of the nut 16 herein is formed, for example, on the inner circumference of the nut or the outer circumference of the nut.

The compressor impeller 12 may be connected to the tip region 13*e* of the shaft 13 by shrink-fitting or press-fitting an annular member, in place of the nut 16 screwed to the shaft 13, to the one axial end of the shaft 13.

Although the turbo charger provided in the engine has been described in this embodiment, the present invention can be applied to other devices provided with the impeller rotator, for example, a gas turbine. The present invention can be also applied to other rotators such as a motor.

Although the embodiments of the present invention have been described with reference to the figures, the present invention is not limited to the illustrated embodiments. Various changes and modifications can be made to the illustrated embodiments in the same scope as the present invention or in an equivalent scope.

INDUSTRIAL APPLICABILITY

The impeller rotator according to the present invention is advantageously used in a charger of an internal combustion engine.

DESCRIPTION OF REFERENCE SIGNS

11: Turbine impeller
12: Compressor impeller
13: Shaft
14: Bearing
15: Center housing
16: Nut
17: Caulked portion
18: Projection
21: Impeller rotator
22: Shaft-equipped impeller.

The invention claimed is:

1. An impeller rotator comprising:

a turbine impeller having imbalance around a rotary axis;

a compressor impeller having imbalance around a rotary axis;

a shaft configured to connect the turbine impeller to the compressor impeller; and a connecting member attached to one axial end of the shaft to fasten one of the turbine impeller or the compressor impeller to one axial end region of the shaft, the connecting member having at least one portion extending beyond the one axial end of the shaft in an axial direction, wherein the at least one portion of the connecting member extending beyond the one axial end of the shaft in the axial direction is plastic-deformed so as to decrease an overall imbalance of the turbine impeller, the compressor impeller, and the shaft.

2. The impeller rotator according to claim 1, wherein an other axial end of the shaft is integrated with an other of the turbine impeller and the compressor impeller.

3. The impeller rotator according to claim 1, wherein the connecting member is a nut screwed to the one axial end of the shaft.

4. The impeller rotator according to claim 3, wherein the at least one portion of the connecting member extending beyond the one axial end of the shaft is an axial end of the nut, and the axial end of the nut is caulked to correct rotational balance of the impeller rotator.

5. The impeller rotator according to claim 3, wherein the nut has a plurality of projections spaced around the rotary axis, and the projections are bent to correct rotational balance of the impeller rotator.

6. The impeller rotator according to claim 5, wherein the projections are arranged at an axial end of the nut, the at least one portion of the connecting member extending beyond the one axial end of the shaft comprises at least one of the projections.

7. The impeller rotator according to claim 1, wherein the at least one portion of the connecting member extending beyond the one axial end of the shaft is plastic-deformed by an amount based on the overall imbalance of the turbine impeller, the compressor impeller, and the shaft.

8. The impeller rotator according to claim 1, wherein the at least one portion of the connecting member extending beyond the one axial end of the shaft is plastic-deformed by caulking the at least one portion of the connecting member extending beyond the one axial end of the shaft to decrease the overall imbalance of the turbine impeller, the compressor impeller, and the shaft.

9. The impeller rotator according to claim 1, wherein the at least one portion of the connecting member extending beyond the one axial end of the shaft is plastic deformed by bending the at least one portion of the connecting member extending beyond the one axial end of the shaft to decrease the overall imbalance of the turbine impeller, the compressor impeller, and the shaft.

* * * * *